US005196674A

United States Patent [19]

Chartrain et al.

[11] Patent Number: 5,196,674

[45] Date of Patent: Mar. 23, 1993

[54] COOKING APPARATUS, FOR EXAMPLE AN OVEN HAVING A PROTECTOR FOR AN ELECTRIC HEATING ELEMENT

[75] Inventors: Pierre Chartrain, Soliers Bourguebus; Bernard M. Bois, Caen, both of France

[73] Assignee: Moulinex (Societe Anonyme), Bagnolet, France

[21] Appl. No.: 819,130

[22] Filed: Jan. 10, 1992

[30] Foreign Application Priority Data

Jan. 17, 1991 [FR] France ..... 91 00480

[51] Int. Cl.[5] ..... F27D 11/02; F24C 7/04

[52] U.S. Cl. ..... 219/411; 392/424; 362/376

[58] Field of Search ..... 219/405, 411; 392/412, 392/416, 424; 362/376; D26/119

[56] References Cited

U.S. PATENT DOCUMENTS

| | | | |
|---|---|---|---|
| 1,118,827 | 11/1914 | Thomas | 362/376 |
| 1,496,811 | 6/1924 | Lange | 362/376 |
| 2,081,395 | 5/1937 | Du Bois | 392/416 |
| 2,337,745 | 12/1943 | Garstang | 362/376 |
| 3,059,086 | 10/1962 | Pedersen | 392/416 |
| 3,163,842 | 12/1964 | Wittwer | 392/416 |
| 3,204,085 | 8/1965 | Busby | 392/424 |
| 4,267,429 | 5/1981 | Fleer | 219/411 |
| 4,885,670 | 12/1989 | Baake | 362/376 |

FOREIGN PATENT DOCUMENTS

| | | | |
|---|---|---|---|
| 2210968 | 6/1989 | United Kingdom | 362/376 |

*Primary Examiner*—Teresa J. Walberg
*Attorney, Agent, or Firm*—Young & Thompson

[57] ABSTRACT

Cooking apparatus such as, for example, an oven includes a cooking chamber (1) having at least one electrical heating element (9) having a tubular envelope (10) of fragile material of the type of quartz or glass which is mounted in supports (16, 17) secured to the chamber (1) so as to maintain the envelope (10) at a distance from the internal wall of the chamber. The tubular envelope (10) is enclosed in a cage (18) whose wall (19) is sufficiently pierced to let pass the infrared radiation toward the interior of the chamber (1) and sufficiently rigid to resist any mechanical shock. The cage (18) is provided with members (24, 25) for securing it to the internal wall of the chamber (1).

6 Claims, 1 Drawing Sheet

COOKING APPARATUS, FOR EXAMPLE AN OVEN HAVING A PROTECTOR FOR AN ELECTRIC HEATING ELEMENT

FIELD OF THE INVENTION

The invention relates to cooking apparatus such as, for example, ovens having a forwardly open cooking chamber and comprising at least one electrical heating element having a tubular envelope of fragile material of the glass or quartz type, which contains a heating wire and whose ends are connected respectively to two bases disposed each at one end of the envelope, each base being adapted to be mounted in a support fixed to said chamber so as to maintain said envelope at a distance from the internal wall of the chamber.

BACKGROUND OF THE INVENTION

Until now, in ovens (or grills) of this type, the electrical element with a fragile envelope projects into the chamber and is in danger of being damaged when the user carelessly manipulates the food to be cooked, or even when he cleans the chamber. This is even more important for a quartz heating envelope whose envelope cannot be touched by the fingers of the hand.

Moreover, these ovens do not meet the latest safety standards which require a certain electrical and/or mechanical protection of the heating element.

The invention thus has for its object to overcome these drawbacks and to cause these ovens to conform to present standards.

SUMMARY OF THE INVENTION

According to the invention, the tubular envelope is enclosed in a cage whose wall is sufficiently pierced to let pass the infrared radiation toward the interior of the chamber, and sufficiently rigid to resist a possible mechanical shock, said cage having securement means to the internal wall of the chamber.

Thus, the fragile tubular envelope is protected against any shock or handling by the user, and the heating element thus satisfies the safety standards.

Moreover, another advantage connected with this protection of the envelope is the possibility for the manufacturer to use a heating element with a quartz envelope whose thickness is about one millimeter instead of the two millimeters ordinarily proposed, and therefore to reduce the cost of the heating element.

BRIEF DESCRIPTION OF THE DRAWINGS

The characteristics and advantages of the invention will appear from the description which follows, by way of example, with reference to the accompanying drawing, in which.

DETAILED DESCRIPTION OF THE INVENTION

Figure 1:
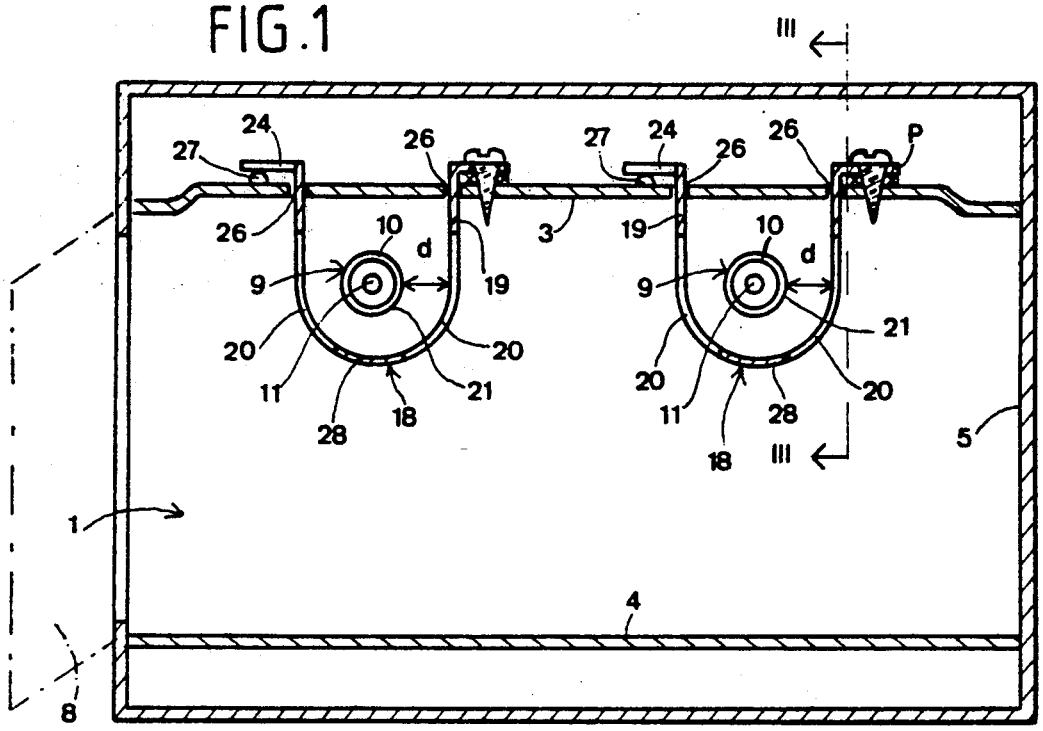
FIG. 1 is a schematic vertical sectional view of a cooking apparatus according to the invention and showing two heating elements enclosed respectively in two protective cages.

The cooking apparatus shown in FIG. 1 is a household oven having a cooking chamber 1 which is forwardly open and whose internal wall forms the vault 3, the sole 4, the rear 5 and the two sides 6 and 7, said forward surface being adapted to be closed by a door 8 (shown schematically in broken line).

This cooking chamber 1 comprises at least an electric heating element 9 having a tubular envelope 10 of fragile material of the type of quartz or glass, which contains a heating wire 11 and whose ends 12 and 13 are connected respectively to two bases 14 and 15 disposed each at one end of the envelope, each base 14, 15 being adapted to be mounted in a support 16, 17 secured to said chamber 1 so as to maintain said envelope 10 at a distance from the internal wall of the chamber.

As will be seen, and so as to obtain better heating, the cooking chamber 1 contains two heating elements 9 whose tubular envelope 10 has the shape of a straight barrel, the bases 14 and 15 being supported by the supports 16 and 17 provided on the sides 6 and 7 of the chamber 1 so as to maintain the two envelopes 10 parallel to each other and at a distance from the vault 3.

The illustrated elements 9 are of the type having a quartz envelope, but could also be of the halogen type with a glass envelope.

According to the invention, the tubular envelope 10 of the heating element 9 is enclosed in a cage 18 whose wall 19 is sufficiently pierced to let pass the infrared radiation toward the interior of the chamber 1, and sufficiently rigid to resist a possible mechanical shock, said cage 18 comprising means for securing the same on the internal wall of the chamber. The cage 18 is preferably of sheet metal and comprises a grounding tongue P adapted to be electrically connected to the chamber 1, for example by means of a screw.

The cage 18 has the form of a trough whose wall 19 has perforations 20 and is coextensive with but spaced from the side wall 21 of the tubular envelope 10 directed toward the interior of the chamber, and whose longitudinal edges 22, 23 comprise securement means.

Figure 2:
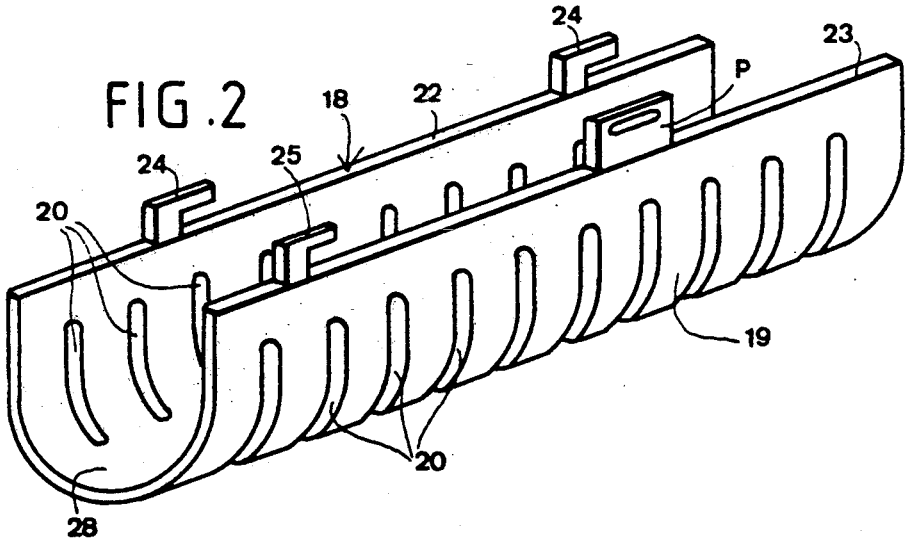
FIG. 2 shows in perspective and on a larger scale a protective cage according to the invention.

As seen better in FIG. 2, the securement means are in the form of lugs 24, 25 provided on the longitudinal edges 22 and 23 of the trough, while the internal wall of the chamber forming the vault 3 has slots 26 adapted to receive the lugs 24 and 25 as well as the grounding tongue P.

Figure 3:
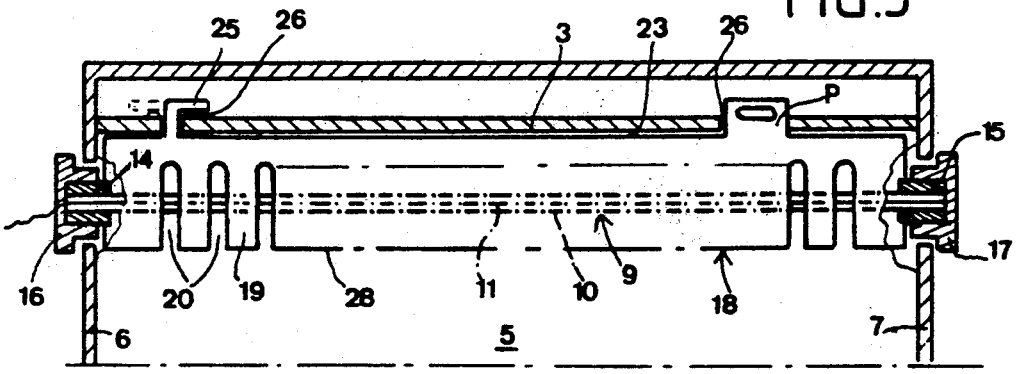
FIG. 3 is a fragmentary vertical cross sectional view on the line III—III of FIG. 1, but with the cage not yet fixedly secured to the chamber.

To secure the cage 18 against the vault 3, the lugs 24, 25 are deformed by twisting so as to direct them transversely of the slots 26 (position illustrated in full lines in FIG. 1 and in broken lines in FIG. 3). Then the tongue P is bent back over the vault 3, and the electrical grounding is ensured by the screw.

To ensure application of the edges 22 and 23 of the trough against the vault 3 and to take up any possible play due to industrial production of the lugs and of the sheet metal constituting the cage, the wall of the chamber, in the present case the vault 3, comprises bosses 27 located respectively near the slots 26 on which will come to bear, after twisting, said lugs.

To guarantee a certain rigidity to the cage 18 while reducing to the minimum the infrared radiation necessary for cooking, the bottom of the trough has an imperforate region 28 extending longitudinally of said envelope, while the perforations 20 are comprised by oblong openings disposed transversely to the tubular envelope 10 and symmetrically relative to this region 28.

Moreover, so as to meet present safety standards, there is given to the openings 20 a width less than 5 millimeters, and to the distance d between the internal surface of the trough and the side wall 21 of the envelope 10 a value greater than 4 millimeters.

Thus, as will be understood, thanks to the cage 18 which bears on the vault 3, there is obtained effective protection against any possible mechanical shock and also against blows applied by "a spring shock apparatus" adapted to verify conformity with the oven standards.

Moreover, thanks to this cage 18, in the case of a quartz envelope, the thickness of said envelope can be reduced so as to use lighter tubes, for example, a thickness of 1 millimeter is chosen instead of two.

Of course, other modifications of embodiment of the cage can be provided without departing from the scope of technical equivalents, such as, for example: a single cage enclosing two parallel envelopes; a cage formed of a metallic or expanded sheet metal screen; and other means for securement against one of the walls of the chamber.

What is claimed is:

1. Cooking apparatus comprising an oven having a forwardly opening cooking chamber (1)and at least one electrical heating element (9) in the chamber, said chamber having an internal wall, said electrical heating element having a tubular envelope (10) of fragile material which contains a heating wire (11) and whose ends (12 and 13) are connected respectively to two bases (14 and 15) each disposed at one end of the envelope, each base being adapted to be mounted in the support (16, 17) secured to said chamber (1) so as to maintain said envelope (10) spaced from the internal wall of the chamber, said tubular envelope (10) having the shape of a straight barrel and being enclosed in a cage (18) having the form of a trough whose wall (19) has perforations to let pass infrared radiation from the heating wire (11) toward the interior of the chamber (1), and is sufficiently rigid to resist any mechanical shock, said wall (19) further having longitudinal edges which include means for securing (24, 25) the cage (18) to the chamber, and said cage (18) being spaced from a side wall (21) of the tubular envelope (10) turned toward the interior of the chamber.

2. Cooking apparatus according to claim 1, wherein the perforations (20) are provided by oblong openings disposed transversely to the tubular envelope (10).

3. Cooking apparatus according to claim 2, wherein the base of the trough has an imperforate region (28) extending longitudinally of the tubular envelop (10), with the openings (20) being disposed symmetrical relative to said imperforate region.

4. Cooking apparatus according to claim 2, wherein the width of the openings (20) is less than 5 millimeters and the distance d between the internal surface of the trough and the side wall (21) of the tubular envelope (10) is greater than 4 millimeters.

5. Cooking apparatus according to claim 1, wherein the cage (18) is of sheet metal and includes a grounding tongue (P) adapted to be electrically connected to the chamber (1).

6. Cooking apparatus according to claim 1, wherein the means for securing are comprised by lugs on the longitudinal edges (22, 23) of the trough, said internal wall of the chamber (1) having slots (26) adapted to receive said lugs, and said cage (18) being securable to the internal wall of the chamber (1) by deformation of the lugs to direct them transversely of the slots (26).

* * * * *